United States Patent [19]

Giulie

[11] B 4,007,950

[45] Feb. 15, 1977

[54] BINDER UNIT FOR STAPLED BOOKLETS

[75] Inventor: Joe D. Giulie, Palo Alto, Calif.

[73] Assignee: Minnesota Mining and Manufacturing Company, St. Paul, Minn.

[22] Filed: July 24, 1974

[21] Appl. No.: 491,618

[44] Published under the second Trial Voluntary Protest Program on March 16, 1976 as document No. B 491,618.

[52] U.S. Cl. ..... 281/25 R; 402/14; 85/49

[51] Int. Cl.[2] ..... B42D 1/00

[58] Field of Search ..... 281/25 R, 21 R, 29, 281/36, 37; 85/49; 24/153 LS, 94; 270/37, 53; 206/523; 402/14, 18

[56] References Cited

UNITED STATES PATENTS

| | | | |
|---|---|---|---|
| 1,371,739 | 3/1921 | Dawson | 281/36 |
| 1,410,000 | 3/1922 | Dawson | 281/25 R |
| 2,000,357 | 5/1935 | Smith | 281/25 R |
| 3,188,114 | 6/1965 | O'Brien et al. | 281/21 R |
| 3,347,565 | 10/1967 | Konkel | 281/29 X |
| 3,631,297 | 12/1971 | Conner | 206/523 X |

FOREIGN PATENTS OR APPLICATIONS

| | | | |
|---|---|---|---|
| 2,645 | 7/1926 | Australia | 281/25 R |

*Primary Examiner*—Jerome Schnall
*Attorney, Agent, or Firm*—Alexander, Sell, Steldt & DeLaHunt

[57] ABSTRACT

A binder unit for stapled booklets is provided, having an edge member joining the front and back covers of the booklet wherein the edge member has a space in which the terminal ends of the staples are concealed. The space may be empty or it may be occupied by a easily compressible material such as foam plastic.

1 Claim, 8 Drawing Figures

BINDER UNIT FOR STAPLED BOOKLETS

SUMMARY OF THE INVENTION

Small booklets such as advertising brochures, price lists, and the like are frequently bound together by staples. Cover members have been available on the market for some time which cover the thus bound edge of the pamphlet, making it appear to be a regularly bound volume. Such edge members have ordinarily consisted of a relatively narrow strip of material which is stapled onto the edge of a sheaf of papers, the strip having a second narrow strip in proximity thereto which is folded back on the first strip, and a longer, wider strip attached thereto which is wrapped around the end of the sheaf of paper and terminates on the back side. Although such backing members give a neat appearance to the volume, they do have the disadvantage that the terminal staple ends which have been processed in a normal stapling machine, rise somewhat above the surface of the first backing strip and push upwardly into the second backing strip so that it is immediately apparent, due to the bulges, that the volume has been assembled by staples and not by some more sophisticated binding means.

In accordance with the present invention binding strips are provided which cover the edge of the bound pamphlet or the like and which completely conceal the terminal ends of the staples so that the appearance of the finished volume is such that one would ordinarily assume that it had been assembled and bound by some more professional type of binding.

This is accomplished by providing a space between the first and second binding strips so that the terminal ends of the staples are fully concealed and do not provide giveaway bulges on the surface.

The space between the first and second binding members can be either hollow or it can be filled with a resilient material which compresses at the position where the staples are located, so that the bent over staple ends do not produce a bulge.

BRIEF DESCRIPTION OF THE DRAWINGS

In the drawings forming part of this application.

DESCRIPTION OF THE PREFERRED EMBODIMENTS

Figure 1:
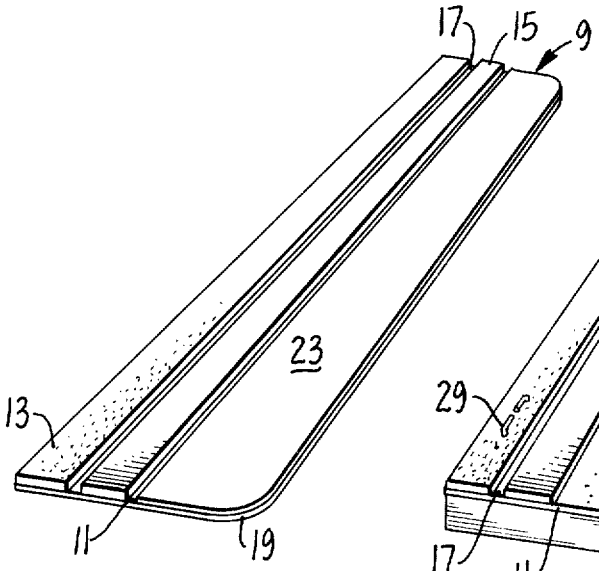
FIG. 1 is a perspective view of a binding element embodying the present invention wherein foam rubber acts as the spacing element.
Figure 2:
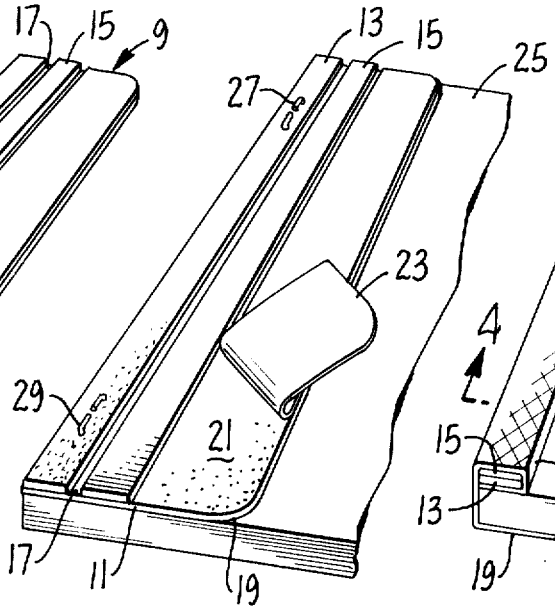
FIG. 2 is a perspective view showing the first step of applying the element to a volume to be bound.

Referring now to the drawings by reference characters and particularly FIGS. 1 through 5, there is shown an edge binding unit for a pamphlet generally designated 9. The binder unit consists of a flexible backing 11 which underlies the entire binding element and on one edge of the strip a foam plastic member 13 is provided which can be adhered to the backing in any suitable means such as an adhesive. Lying parallel to this foam backing strip and spaced slightly therefrom is a second strip 15 of substantially the same dimensions and this strip may be made either of a foam plastic as was the first strip or, preferably, can be a stiffer material such as ordinary cardboard. The space between them, designated 17, is approximately equal to the thickness of the two strips so that eventually the two strips can overlie each other while the backing portion represented by the flexible backing 11 in the space 17 will wrap around the edge of these two strips to form a smooth edge. This leaves a large flap 19 of the flexible backing material and this flap portion of the strip is covered with a pressure-sensitive adhesive 21 protected by release paper 23.

Figure 4:
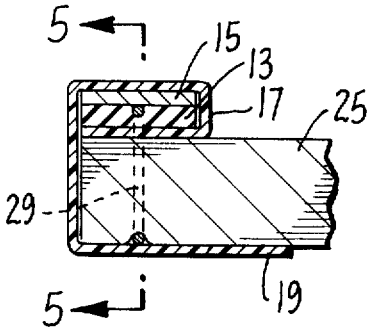
FIG. 4 is an enlarged section on the line 4—4 of FIG. 3.
Figure 5:
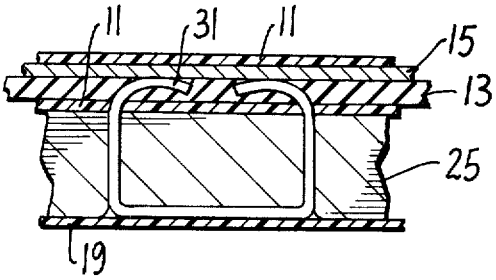
FIG. 5 is a section on the line 5—5 of FIG. 4.

To use the binding strip of the present invention, a sheaf of papers 25 is first brought to the desired alignment and the binding unit is placed at the edge so that strip 13 lies along the left margin of the sheaf with the front cover of the booklet up. One now inserts a desired number of staples from the rear so that the terminal ends extend upwardly and through strip 13 as at 27 and 29. As can be seen in FIGS. 4 and 5, the usual stapling machine makes a smooth job at the closed end of the staple, compressing the paper somewhat, so that there is no substantial bulge at the closed end. However, as is best seen in FIG. 5, the ends 31 extend a substantial distance above the flexible backing 11 and would normally make a substantial bulge if one tried to cover them with a thin strip of material. Howeveer, as is again best seen in FIGS. 4 and 5, the foam material 13 provides a resilient bed so that when the ends are turned in, they sink into the foam and do not extend above it.

Figure 3:
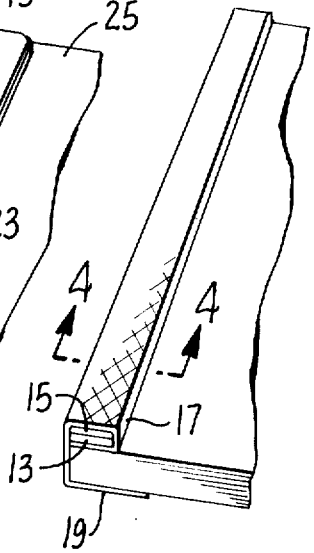
FIG. 3 is a view showing the finished bound pamphlet.

After the strip 13 is initially stapled to the front cover, the binding unit is then bent back upon itself so that the strip 15 overlies the strip 13 and the material at 17 forms a neat edge between the two. The release paper 23 is now peeled off and the portion 19 with the pressure-sensitive adhesive 21 is pulled around the back edge and back of the book as is shown in FIG. 3. This produces a neat effect and there are no bulges either on the front or the back of the finished volume.

Instead of utilizing the foam material to provide a space for the terminal ends of the staples, this space may be left hollow by the employment of suitable spacing elements between the strips which ultimately form the left edge of the front cover. The means of accomplishing this is shown in FIGS. 6 and 7 and a slight variation thereof shown in FIG. 8.

Figure 6:
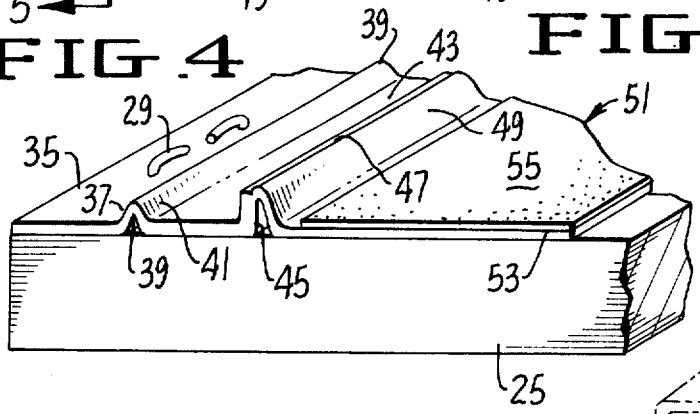
FIG. 6 is a corner section showing another embodiment of the invention wherein the space between the first two strips is hollow.
Figure 7:
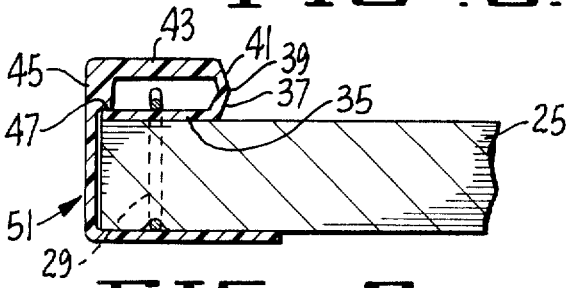
FIG. 7 is a section through the edge of a volume bound with the element of FIG. 6.

In the embodiment shown in FIGS. 6 and 7, the binding member is made of a single piece of plastic, normally an extruded thermoplastic which is somewhat flexible and which can be formed in thin sections to provide a "living hinge". Thus, the binder element consists of a single extrusion having a flat section 35 with an upturned thick edge 37. This connects to a hinge portion 39 which in turn is connected to a downturned portion 41 and a second flat section 43 which is substantially the same width as 35. Connected to this is the upturned shoulder 45 and a second living hinge 47. This leads to a downturned sectin 49 terminating in a relatively wide section 51. Section 51 is covered with a pressure-sensitive adhesive 53 over which there is a release paper 55 similar to that previously described.

In order to employ this embodiment of the invention, section 35 is placed over the top left margin and stapled as previously described. The binder is now bent back upon itself so that the section 43 overlies the section 35 and is maintained in spaced relationship therefrom by the upturned sections 37 and 41 on one side and by the shoulder 45 on the other side thereof. The wide portion 51 is handled as previously described, i.e. the release paper is stripped off and 51 is brought around the edge and back of the pamphlet and adhered thereto. This leaves a finished structure as is shown in FIG. 7.

Figure 8:
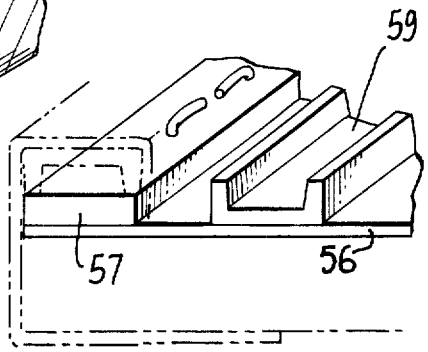
FIG. 8 is a perspective view of the corner of a volume showing the initial position of the parts in solid lines, and showing the final position of the binder in dot/dash lines.

A slight variation of the embodiment shown in FIGS. 6 and 7 is shown in FIG. 8. Here, a relatively thin piece of material 56 is employed which can be similar to the backing material 11 shown in FIGS. 1 through 5. A first strip 57 of a cardboard or the like is employed at the left terminal edge while a U-shaped 59 of substantially the same width is adhered to 56 in spaced relationship adjacent to the strip 57. The balance of the binder can be as shown at 19 in FIG. 1. This strip is installed in the same way as is shown in dot/dash lines in FIG. 8; the U-shaped channel overlies the staples so that a smooth top surface is provided, hiding the fact that the initial pamphlet is stapled.

Although certain specific structures have been shown, it will be obvious to those skilled in the art that many variations can be made.

I claim:

1. A binding unit for a stack of paper having opposite first and second major surfaces and a spine edge surface around which said binding unit is attached, said binding unit comprising in combination:

a thin elongated generally rectangular flexible backing having an elongate edge, said backing having a first elongate portion adjacent said elongate edge contacting the first major surface of said stack of paper with the elongate edge of said backing positioned along the spine edge surface of the stack of paper;

a plurality of U-shaped staples through the stack of paper and the first portion of said backing, said staples having central portions along the second major surface of the stack of paper and having terminal ends clinched over the first portion of said backing;

an elongate strip of foam plastic corresponding in shape with the first portion of said backing and being adhered to the first portion of said backing on its surface opposite the stack of paper, said staples extending through said strip of foam plastic and said clinched over ends being embedded in said foam plastic, said strip of foam plastic having a thickness adapted to totally receive the clinched ends of the staples so that said ends do not extend above the foam plastic;

a second strip congruent to said first strip and lying over said strip of foam plastic and over the terminal ends of said staples on the side of said strip of foam plastic opposite said stack of paper;

said backing member extending from said strip of foam plastic around said second strip and being adhered to the surface of the second strip opposite said strip of foam plastic, and extending from said second strip around the spine edge surface of said stack of paper and over at least a portion of the second major surface of said stack of paper and being adhered thereto to cover the central portion of said staples.

* * * * *